US012486626B2

(12) United States Patent
Hedstrom et al.

(10) Patent No.: US 12,486,626 B2
(45) Date of Patent: Dec. 2, 2025

(54) QUICK CHANGE ROTOR ALIGNMENT FEATURE

(71) Applicant: Caterpillar Paving Products Inc., Brooklyn Park, MN (US)

(72) Inventors: Craig T. Hedstrom, Mounds View, MN (US); Nicholas B. Johnson, Dayton, MN (US); Ryan Hutar, Plymouth, MN (US); Eric S. Engelmann, Delano, MN (US); Mario Persano, Poggio Renatico (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 221 days.

(21) Appl. No.: 18/223,713

(22) Filed: Jul. 19, 2023

(65) Prior Publication Data

US 2025/0027279 A1 Jan. 23, 2025

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/88; E01C 23/127; E01C 23/088; F16D 2001/062
See application file for complete search history.

(56) References Cited

U.S. PATENT DOCUMENTS

| | | | | |
|---|---|---|---|---|
| 4,704,045 | A * | 11/1987 | Taylor | E01C 23/127 404/90 |
| 5,505,598 | A * | 4/1996 | Murray | E01C 23/088 404/90 |
| 6,877,818 | B1 | 4/2005 | Gaertner et al. | |
| 7,144,192 | B2 | 12/2006 | Holl et al. | |
| 8,118,369 | B2 | 2/2012 | Holl et al. | |
| 8,474,919 | B2 | 7/2013 | Cipriani et al. | |
| 9,234,320 | B2 * | 1/2016 | Abresch | E01C 23/127 |
| 9,951,483 | B2 | 4/2018 | Roetsch et al. | |
| 2021/0269994 | A1 | 9/2021 | Wilhelmi et al. | |
| 2024/0328097 | A1 * | 10/2024 | Schroeder | E01C 23/088 |

FOREIGN PATENT DOCUMENTS

| | | |
|---|---|---|
| DE | 102012008252 | 10/2013 |
| DE | 102017220518 A1 | 11/2018 |
| DE | 102022003914 A1 | 4/2023 |

* cited by examiner

*Primary Examiner* — Janine M Kreck

(57) ABSTRACT

A milling machine can include a frame, a milling assembly including a cutting rotor and a rotor housing coupled to the frame, the cutting rotor including a rotor shell positioned around a spindle, and a first axial alignment feature on one of the rotor shell or the spindle, the first axial alignment feature including a physical feature on a surface of the rotor shell or the spindle, the physical feature being positioned and configured to contact an opposing flat surface of the opposing rotor shell or spindle so as to guide the rotor shell and the spindle into a co-axial alignment as the rotor shell is loaded axially onto the spindle.

18 Claims, 7 Drawing Sheets

QUICK CHANGE ROTOR ALIGNMENT FEATURE

TECHNICAL FIELD

The present disclosure generally relates to a milling machine. More particularly, the present disclosure relates to a system and method to change the cutting rotor of the milling machine.

BACKGROUND

Milling machines can include machines such as cold planers and reclaimers. Cold planers are powered machines used to remove at least part of a surface of a paved area such as a road, bridge, or parking lot. Typically, cold planers include a frame, a power source, a milling assembly positioned below the frame, and a conveyor system. The milling assembly includes a cutting rotor having numerous cutting bits disposed thereon. As power from the power source is transferred to the milling assembly, this power is further transferred to the cutting rotor, thereby rotating the cutting rotor about its axis. As the rotor rotates, its cutting bits engage the hardened asphalt, concrete or other materials of an existing surface of a paved area, thereby removing layers of these existing structures. The spinning action of the cutting bits transfers these removed layers to the conveyor system which transports the removed material to a separate powered machine such as a haul truck for removal from a work site.

During a milling process, it may be desirable to switch between cutting rotor having different widths or different pitches. Generally, the cutting rotors are changed as per required cutting characteristics. Typically, a forklift is utilized to assemble the component for changing the cutting rotors due to size and weight of the components. However, the forklift does not provide assembly precision due to poor visibility which leads to difficulty in assembling cutting rotors in a timely manner.

U.S. Pat. No. 8,118,369 discloses a ground milling machine including an interchangeable milling tube of a milling drum.

SUMMARY

In an example according to this disclosure, a milling machine can include a frame, a milling assembly including a cutting rotor and a rotor housing coupled to the frame, the cutting rotor including a rotor shell positioned around a spindle, and a first axial alignment feature on one of the rotor shell or the spindle, the first axial alignment feature including a physical feature on a surface of the rotor shell or the spindle, the physical feature being positioned and configured to contact an opposing flat surface of the opposing rotor shell or spindle so as to guide the rotor shell and the spindle into a co-axial alignment as the rotor shell is loaded axially onto the spindle.

In one example, a milling assembly can include a cutting rotor and a rotor housing, the cutting rotor including a rotor shell positioned around a spindle, and a first axial alignment feature on one of the rotor shell or the spindle, the first axial alignment feature including a physical feature on a surface of the rotor shell or the spindle, the physical feature being positioned and configured to guide the rotor shell and the spindle into a co-axial alignment as the rotor shell is loaded axially onto the spindle, wherein after assembly of the rotor shell to the spindle, the physical feature is not in supporting contact with an opposing surface of the opposing rotor shell or the spindle.

In one example, a method of connecting a rotor shell to a spindle of a milling machine can include loading a rotor shell over a spindle from an installation side of the milling machine, co-axially aligning the rotor shell and the spindle by moving the rotor shell relative to the spindle using axial alignment features on at least one of the rotor shell or the spindle, and assembling the rotor shell to the spindle, wherein, after assembly of the rotor shell to the spindle, the axial alignment features are not in supporting contact with a surface of the opposing rotor shell or the spindle.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
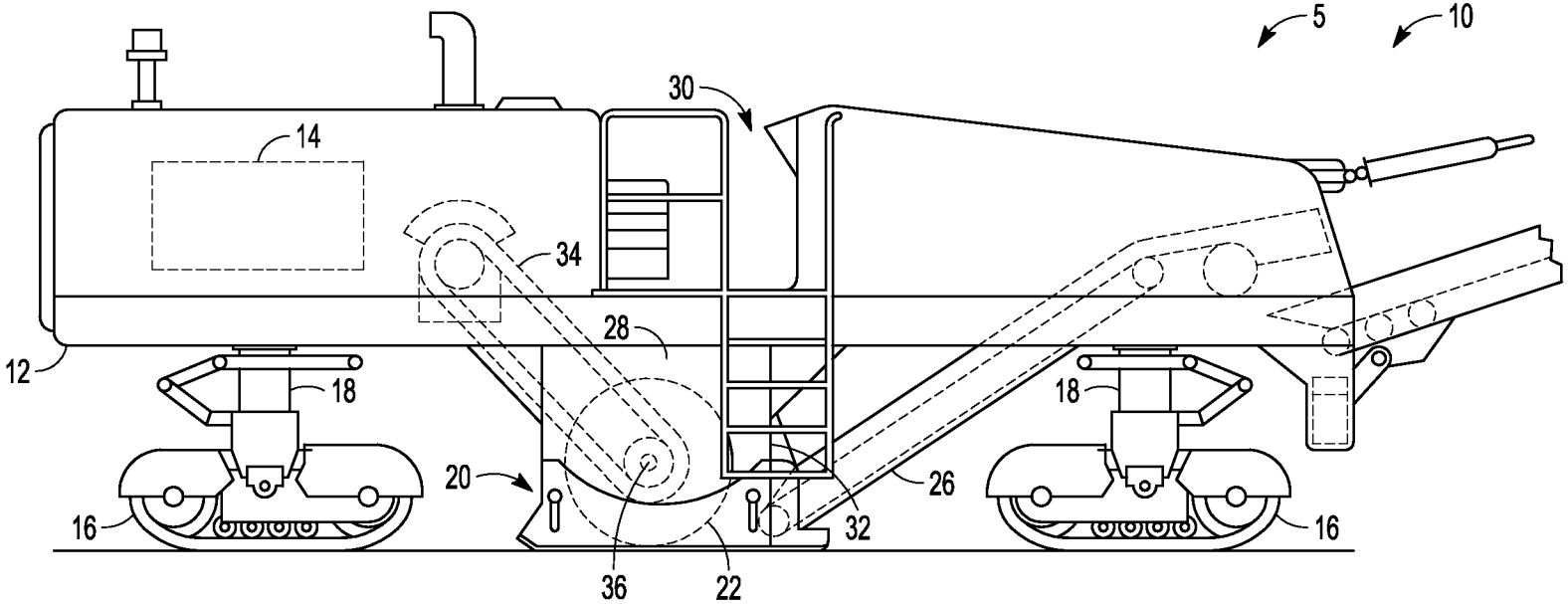
FIG. 1 shows a side view of a cold planer, in accordance with one embodiment.

FIG. 1 shows a side view of a milling machine 5, in accordance with one embodiment. In this example, the milling machine 5 is a cold planer 10. The cold planer 10 includes a frame 12, and a power source 14 connected to the frame 12. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows the cold planer 10 to move in a forward direction over a ground surface, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a rotor housing 28 holding a rotatable cutting rotor 22 operatively connected to the power source 14 via a drive belt 34 which drives a sheave drive 36 coupled to a drive side of the cutting rotor 22. The cutting rotor 22 can be rotated about a drum or housing axis extending in a direction perpendicular to the longitudinal frame axis. As the rotatable cutting rotor 22 spins about its drum axis, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the rotatable drum 22 and its cutting bits then transfers the hardened materials to a first stage conveyor 26 via a discharge port 32 on the rotor housing 28. The first stage conveyor 26 can be coupled to the frame 12 and located at or near the discharge port 32.

The rotor housing 28 includes front and rear walls, and a top cover positioned above the cutting rotor 22. Furthermore, the rotor housing 28 includes lateral covers on the left and right sides of the cutting rotor 22 with respect to a travel direction of the cold planer 10. The rotor housing 28 is open toward the ground so that the cutting rotor 22 can engage in the ground from the rotor housing 28. The rotor housing includes the discharge port 32 in a front wall to discharge material to the first stage conveyor 26.

The cold planer 10 further includes an operator station or platform 30 including an operator interface for inputting commands to a control system for controlling the cold planer 10, and for outputting information related to an operation of the cold planer 10.

Figure 2:
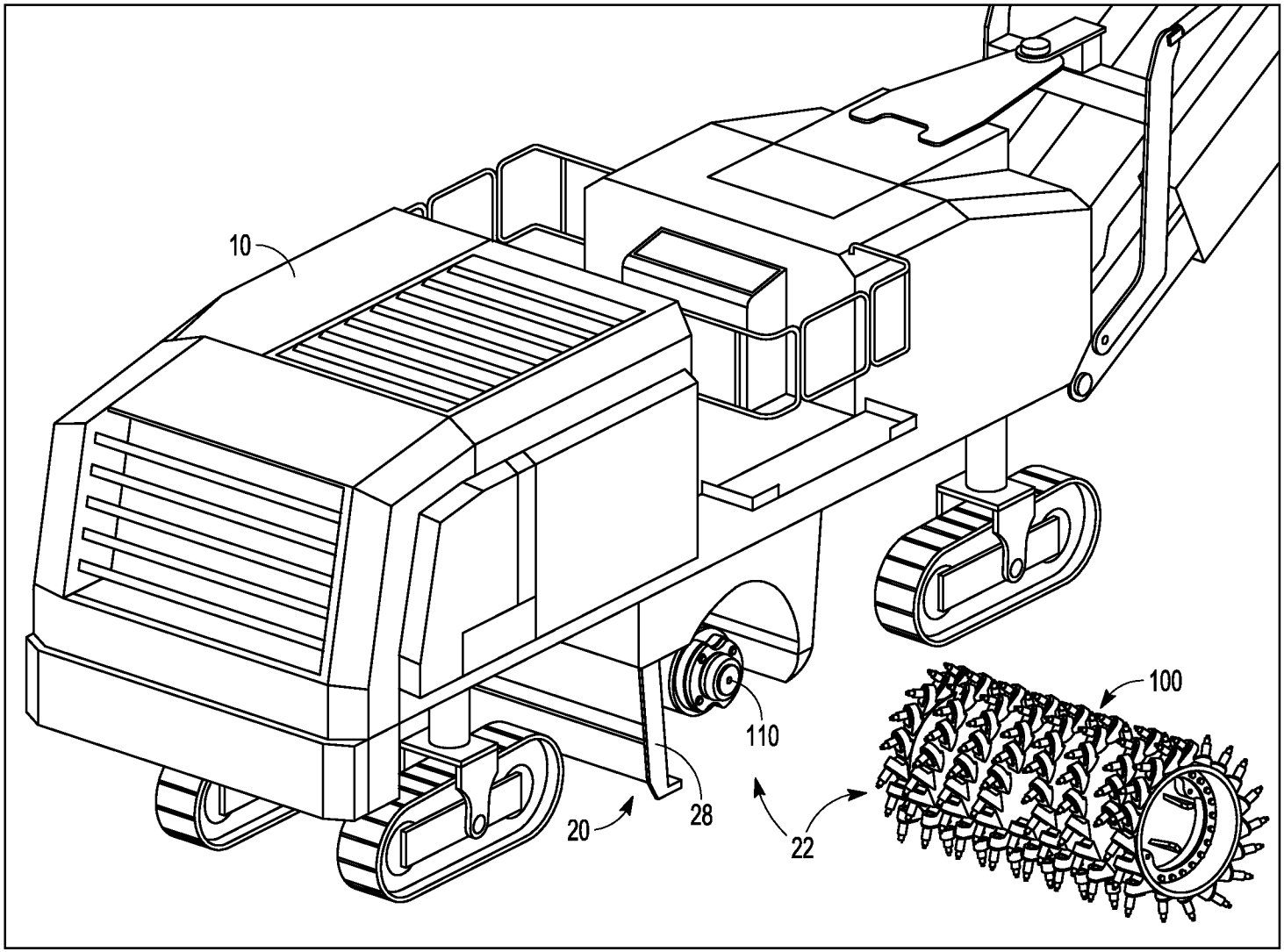
FIG. 2 shows a rear perspective view of the cold planer, in accordance with one embodiment.
Figure 3:
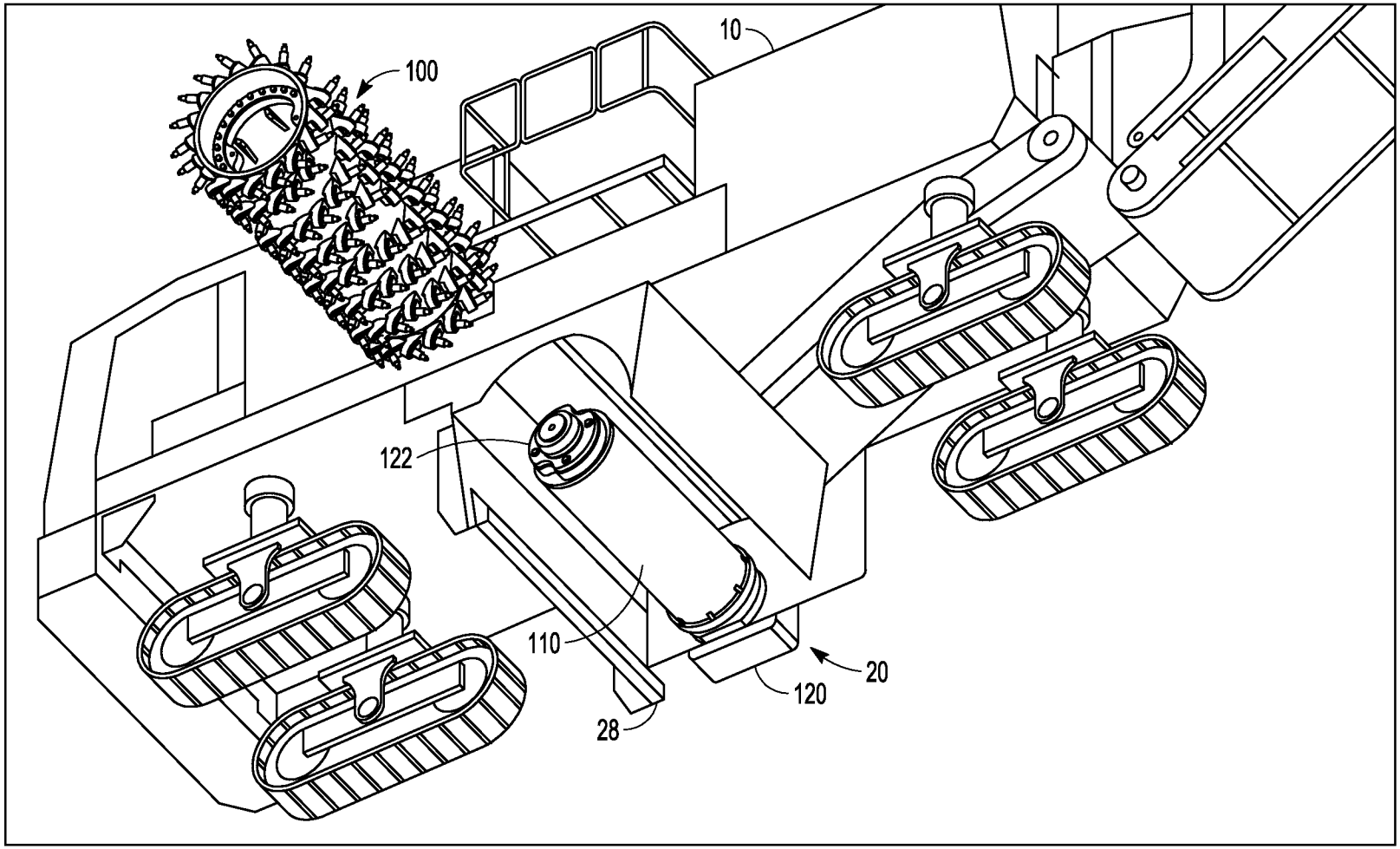
FIG. 3 shows a bottom perspective view of the cold planer of FIG. 2, in accordance with one embodiment.

FIG. 2 shows a rear perspective view of the cold planer 10, and FIG. 3 shows a bottom perspective view of the cold planer 10, in accordance with one embodiment.

Here, the cutting rotor 22 includes an outer rotor shell 100 positioned around an inner spindle 110. The spindle 110 is coupled to the machine 10 at a drive side 120 of the milling assembly 20. The drive side 120 can also be called the left-side in milling terminology. A non-drive side 122, or right side, of the milling assembly 20 is accessible to allow removal of the outer rotor shell 100 from the spindle 110 to allow for a different cutting rotor shell to be installed. For example, the different cutting rotor shell can have different pitch cutting teeth, a different cutting width, or other cutting characteristics.

When changing out rotor shells, the right-hand side plate of the rotor housing 28 is removed to expose the non-drive side 122 of the cutting rotor 22. The old rotor shell is taken off and the rotor shell 100 is then ready to be assembled over the spindle 110.

As noted above, changing out of the rotor shell can be difficult due to the size and weight of the rotor shell and the limited space within the rotor housing. As noted, a forklift is typically utilized to assemble the components for changing the cutting rotors due to size and weight of the components. However, a forklift does not provide assembly precision due to poor visibility which leads to difficulty in assembling cutting rotors in a timely manner.

Accordingly, the present system provides an assembly interface between the rotor shell 100 and the spindle 110 including one or more alignment features to facilitate a quicker change of a cutting rotor in a milling machine.

Figure 4:
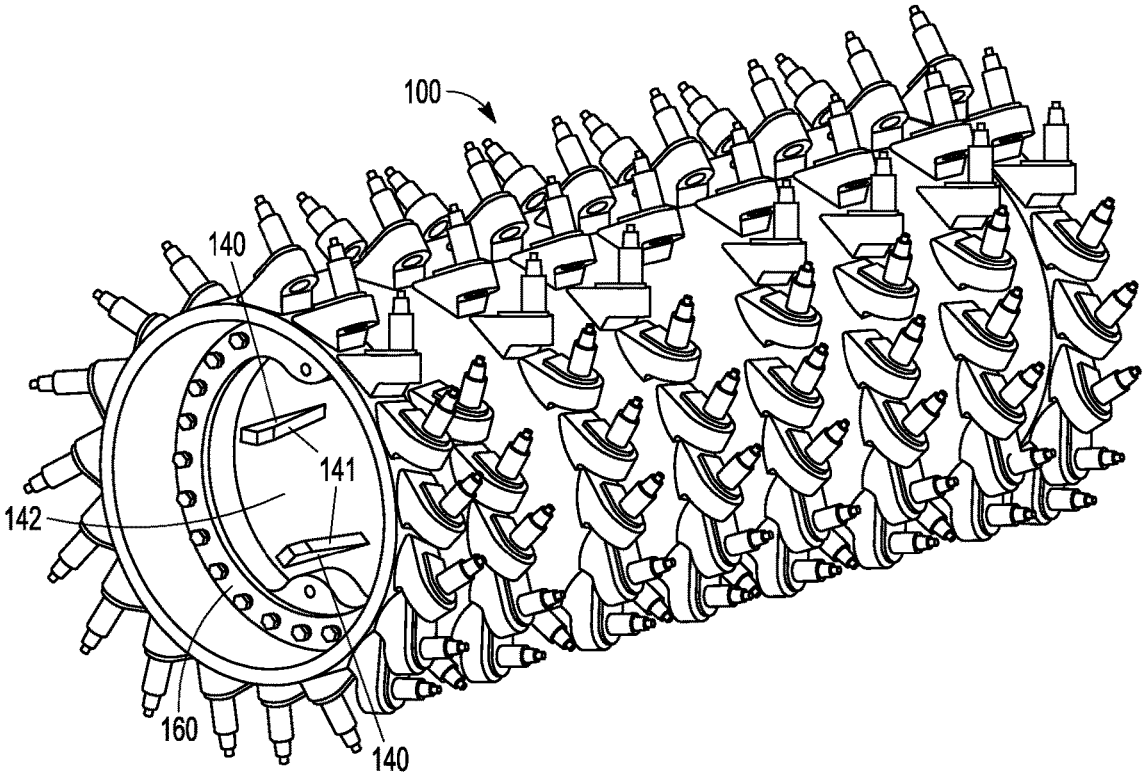
FIG. 4 shows a perspective view of a rotor shell, in accordance with one embodiment.
Figure 5:
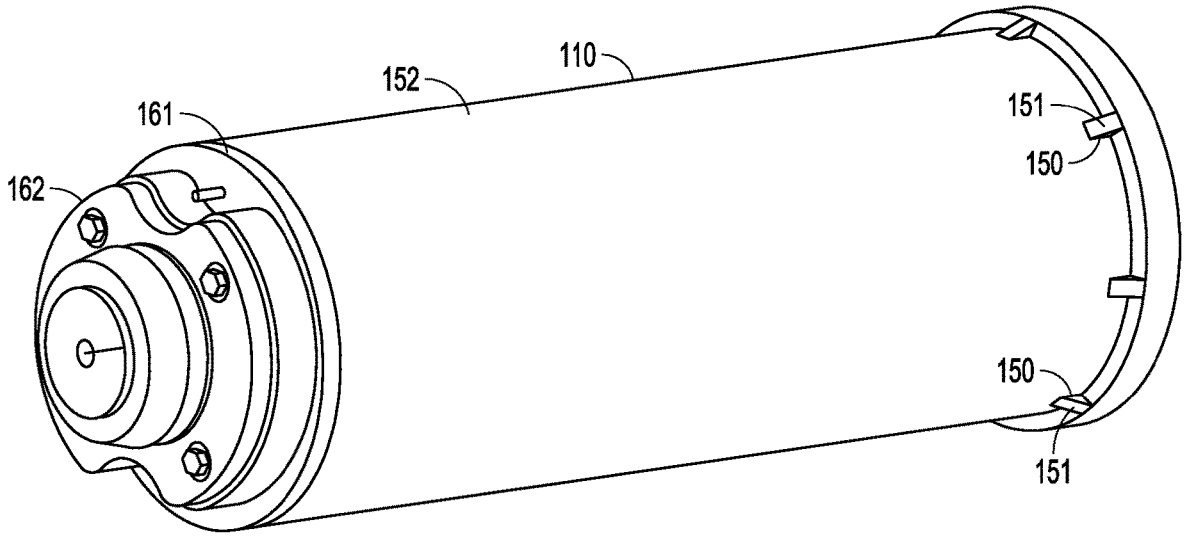
FIG. 5 shows a perspective view of a spindle, in accordance with one embodiment.

For example, FIG. 4 shows a perspective view of the rotor shell 100, in accordance with one embodiment; and FIG. 5 shows a perspective view of the spindle 110, in accordance with one embodiment.

In one embodiment, a plurality of alignment features 140 can be provided on the rotor shell 100. The alignment features 140 can include tapered plates defining a plurality of tapered surfaces 141 that are utilized to guide the assembly components of the cutting rotor for precise fitting. The cutting rotor assembly components include the rotor shell 100 that is loaded coaxially onto the tube or spindle 110 of the cold planer 10 from the side of the machine. In one embodiment, the present system can include axial alignment features on one or both of the rotor shell 100 or the spindle 110 configured for aligning the two parts co-axially while the rotor shell 100 is being loaded onto the spindle 110. In one embodiment, the alignment features 140 can include separate machined members, made of steel, for example, that can be welded to the inner surface of the rotor shell 100.

For example, the rotor shell 100 can include the first axial alignment feature 140 including a physical feature on an inner surface 142 of the rotor shell 100. Here, the first axial alignment feature 140 is on the inner surface 142 of the rotor shell 100 and is located at the non-drive side of the rotor shell 100.

The first axial alignment feature 140 can be structured, shaped, positioned, and configured so as to contact an opposing flat outer surface 152 of the spindle 110 while the rotor shell 100 is being slid over the spindle 110. The first axial alignment feature 140 physically guides the relative axial positions of the rotor shell 100 and the spindle 110 so that when the rotor shell 100 is fully pushed onto the spindle 110, the two parts are co-axially aligned and then opposing keyed features 160, 162 of the rotor shell 100 and the spindle 110 can mate. The flat surface 152 of the spindle 110 means the flat outer surface 152 that is parallel to the longitudinal axis of the spindle 110 and is not in parallel alignment with the tapered surface 141 of the alignment feature 140.

In one embodiment, the system can include a plurality of axial alignment features 150 on the spindle 110. Each of the axial alignment features 150 can include a tapered surface 151 and can be located at the drive end of the spindle 110 and can be positioned and configured to contact an opposing flat surface 142 of the interior of the opposing rotor shell 100 so as to guide the rotor shell 100 and the spindle 110 into a desired co-axial alignment as the rotor shell 100 is loaded coaxially onto the spindle 110 from the non-drive side of the machine. This may be accomplished by radial movement of the rotor shell 100 relative to the spindle 110 as the rotor shell 100 moves in the axial direction over the spindle 110. Again, the flat inner surface 142 of the rotor shell 100 means the flat inner surface 142 of the rotor shell 100 is parallel to the longitudinal axis of the rotor shell 100 and is not in parallel alignment with the tapered surface of the alignment feature 150.

In one example, the axial alignment features 140 on the rotor shell 100 can be omitted and the system only utilizes the axial alignment feature 150 on the spindle 110. Likewise, in another embodiment, the system can utilize the alignment features 140 and omit alignment features 150. In some examples, the alignment features can be provided on both the rotor shell 100 and the spindle 110.

In one embodiment, the first axial alignment feature 140 and the second axial alignment feature 150 can each include the plurality of tapered surfaces 141, 151 that contact the corresponding flat surfaces 142, 152 of the opposed rotor shell 100 or the spindle 110.

The plurality of tapered surfaces 141, 151 can be sized to physically axially align the rotor shell 100 and the spindle 110 so as to be in co-axial alignment when assembled (in other words, the contact between the tapered surfaces 141, 151 causes the rotor shell 100 to move during assembly in such a way as to be co-axially aligned with the spindle 110 when the rotor shell reaches its final position). Here, the axial alignment features 140, 150 include tapered plates defining the tapered surface 141, 151. In other examples, the alignment features 140, 150 can include other physical features, such as conical features.

Figure 6:
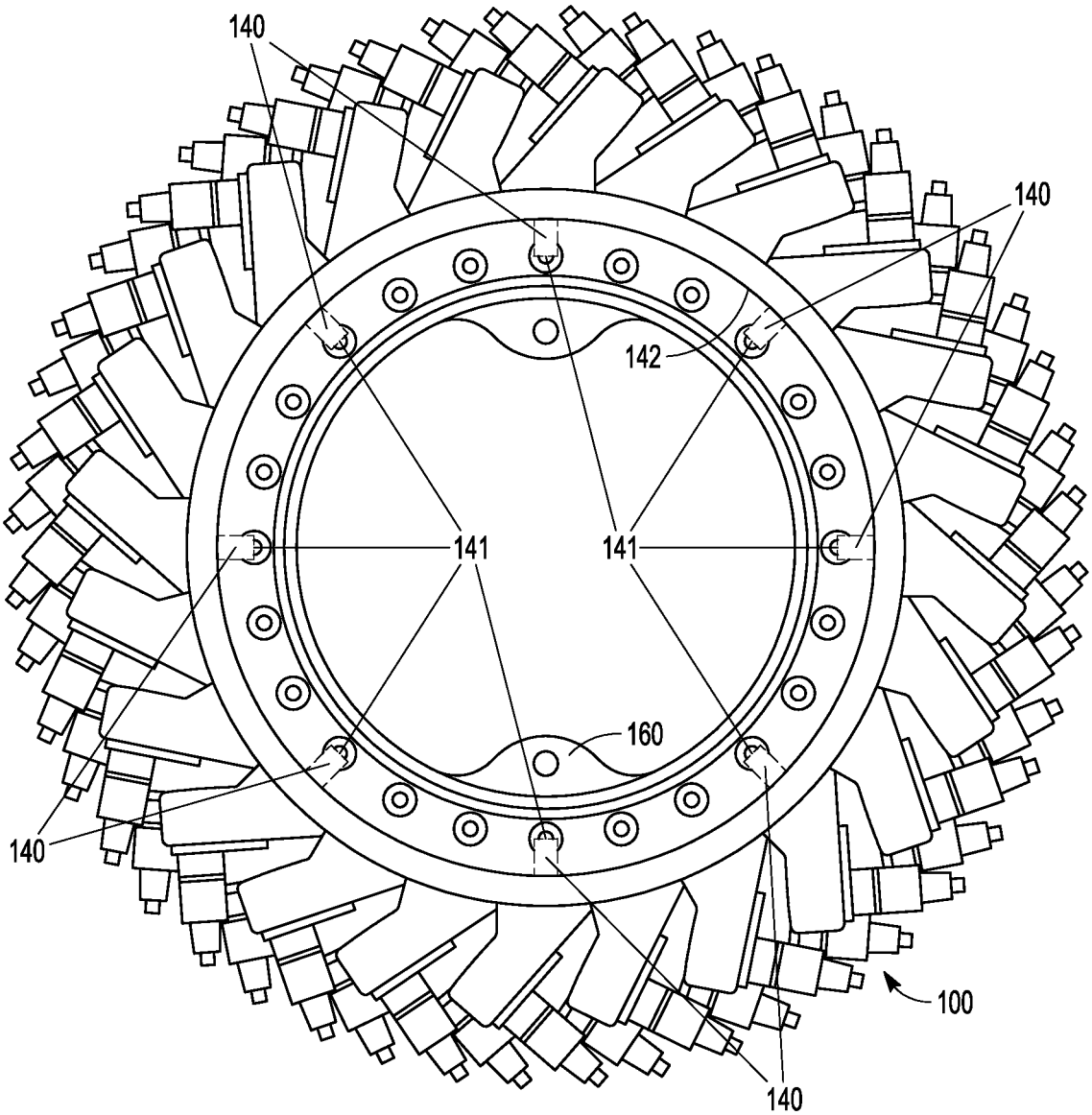
FIG. 6 shows an end view of the rotor shell, in accordance with one embodiment.

FIG. 6 shows an end view of the rotor shell 100, in accordance with one embodiment.

Here, the plurality of axial alignment features 140 can include the plurality of tapered surfaces 141. For example, eight tapered surfaces 141 can be spaced equidistantly around the circumference of the inner surface 142 of the rotor shell 100. In another embodiment, more or fewer than eight tapered surfaces 141 can be provided. The plurality of axial alignment features 140 can be positioned around the circumference of the inner surface 142 of the rotor shell that contact the opposing flat outer surface 152 of the spindle 110 to physically align the rotor shell 100 and the spindle 110 to be in co-axial alignment when the rotor shell 100 is fully assembled, or pushed all the way on, the spindle 110.

Figure 7:
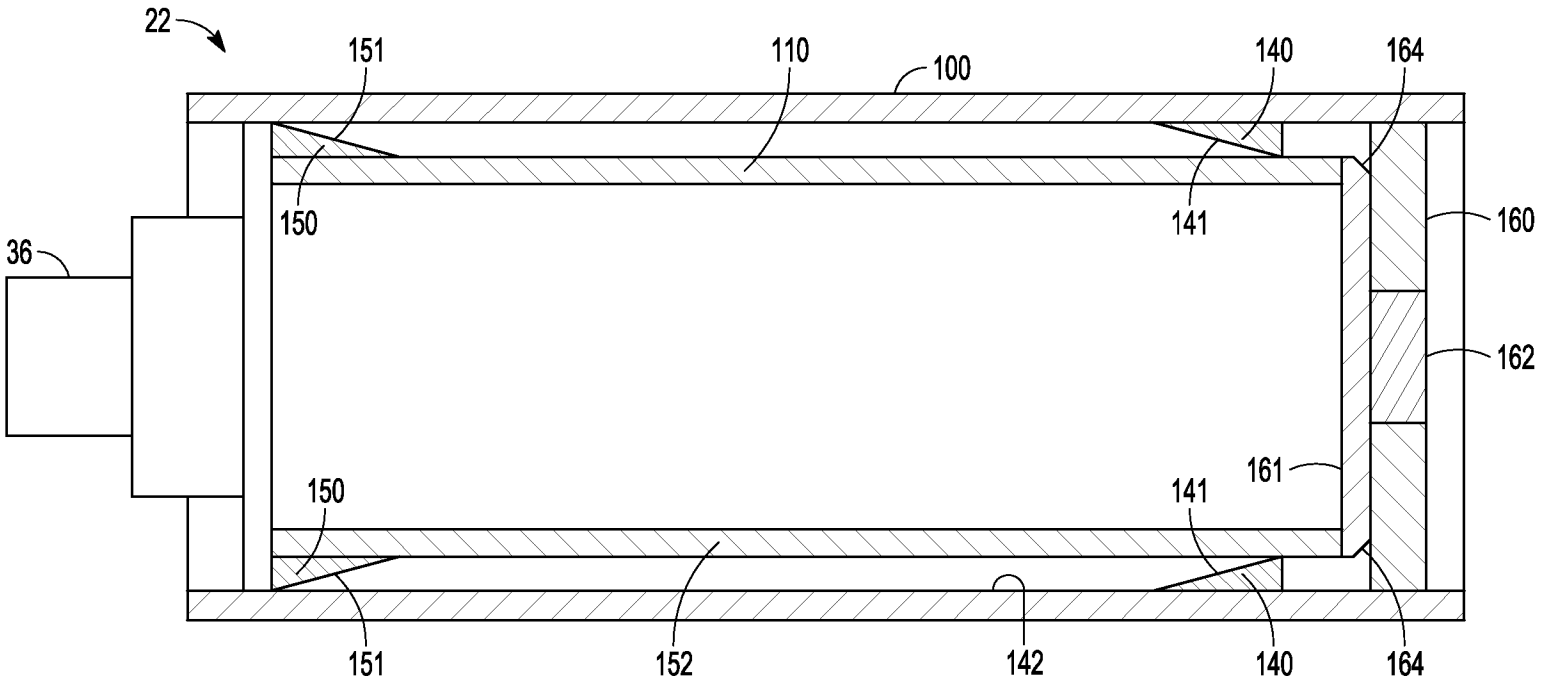
FIG. 7 shows a schematic cross-section view of a cutting rotor, in accordance with one embodiment.

FIG. 7 shows a schematic cross-section view of the cutting rotor 22 in assemble condition, in accordance with one embodiment.

Here, when the cutting rotor 22 is fully assembled, with the rotor shell 100 completely upon the spindle 110, the alignment features 140, 150 are not configured as stops, but are just used for aligning. After assembly of the rotor shell 100 to the spindle 110, the axial alignment features 140 or the axial alignment features 150 are not in supporting contact with the outer surface 152 of the spindle 110 or the inner surface 142 of the rotor shell 100. For example, the alignment features 140 can be a few millimeters separated from the outer surface 152 of the spindle 110. Thus, the alignment features 140, 150 are configured to be non-load bearing, and are only used for co-axial alignment during the installation process. Thus, after assembly of the rotor shell 100 to the spindle 110, when the keyed features 160, 162 are mated, the tapered surfaces of the alignment features 140, 150 are not in supporting contact with the opposing surfaces of the opposing rotor shell 100 or the spindle 110. In one embodiment, a chamfer 164 can be provided on an outer surface of an end 161 on the non-drive side of the spindle 110. The chamfer 164 can be helpful during installation of the rotor shell 100 over the spindle by helping the rotor shell 100 to slide over the spindle 110 during the start of the installation process. Moreover, the chamfer 164 can also help the alignment features 140 on the rotor shell 100 to begin to align during installation when the alignment features 140 contact and slide over the chamfer 164.

Referring to FIGS. 1-7, in an operation to mount the rotor shell 100 to the spindle 110, the non-drive side plate of the rotor housing 28 is removed for access to the non-drive side of the machine. The old rotor shell is removed and a new rotor shell 100 is chosen and delivered using a forklift or other machine. The rotor shell 100 is slid over the spindle 110 until the rotor shell is fully loaded onto the spindle 110. During the installation, the spindle 110 can be turned clockwise or counterclockwise at varying angles so that the keyed features 160, 162 align radially. The alignment features 140, 150 physically axially align the rotor shell 100 and the spindle 110 so that as the components reach the fully assembled position, the two components are co-axially aligned.

INDUSTRIAL APPLICABILITY

The present system is applicable to a milling assembly for a milling machine such as a cold planer or a reclaimer. The milling assembly is suitable as a milling unit of a cold planer for removing at least part of a surface of a paved area such as a road, bridge, and a parking lot. In some embodiments, the milling assembly as disclosed herein may be also applicable as a milling unit of a surface miner in surface mining applications, for example, for mining coal deposits in an open pit mine.

As noted, some users want the ability to quickly and easily swap out milling assemblies for different width cutting rotors or cutting rotors with other different cutting characteristics. However, changing out of the rotor shell can be difficult due to the size and weight of the rotor shell and the limited space.

Figure 8:
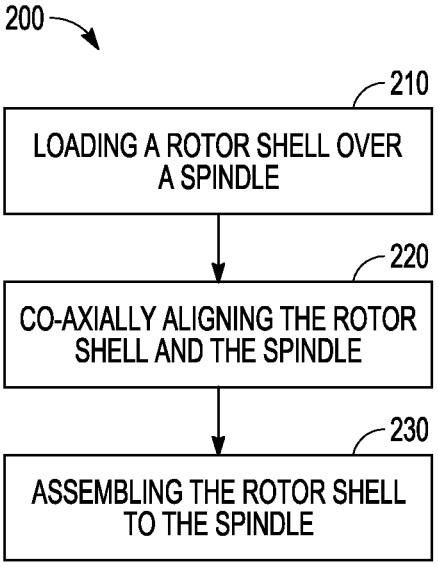
FIG. 8 shows a method of connecting a rotor shell to a spindle of a milling machine, in accordance with one embodiment.

FIG. 8 shows a method (200) of connecting a rotor shell to a spindle of a milling machine, in accordance with one embodiment.

The method (200) can include loading a rotor shell over a spindle (210) from an installation side of the milling machine. As described above, the spindle remains coupled to the machine while the rotor shell is being loaded on to the spindle. The method further includes co-axially aligning the rotor shell and the spindle (220) by moving the rotor shell relative to the spindle using axial alignment features on at least one of the rotor shell or the spindle and assembling the rotor shell to the spindle (230), wherein, after assembly of the rotor shell to the spindle, the first axial alignment feature is not in supporting contact with the surface of the opposing rotor shell or the spindle.

In some examples, there can be keyed features on both the spindle and the rotor shell that mate with each other when the rotor shell is fully assembled to the spindle. In the embodiment shown in FIG. 7 the keyed features 160, 162 are located at the installation-side ends of the rotor shell 100 and spindle 110, respectively.

In further examples, the method can include providing a second axial alignment feature on the other one of the rotor shell or the spindle.

In some examples of the method, the axial alignment feature can be located on an inner surface of the rotor shell and can be located at a non-driven side of the rotor shell, wherein the axial alignment feature includes a plurality of tapered surfaces positioned around a circumference of the inner surface that contact an opposing flat outer surface of the spindle to physically align the rotor shell and the spindle to be in co-axial alignment when the rotor shell is fully assembled upon the spindle.

In summary, the present disclosure relates to changing of milling drums on milling machines, such as a cold planer machine. Generally, the milling drums are changed as per required cutting characteristics in the machine. However, a forklift utilized to change the milling drums does not provide assembly precision due to poor visibility. More particularly, the present disclosure pertains to an alignment feature to quickly change a rotor shell in the cold planer. The alignment feature includes tapered plates or other physical structures that are utilized to guide the assembly components of the cutting rotor for precise fitting. The cutting rotor assembly components include a rotor shell that is loaded coaxially onto a tube or spindle of the milling machine from the side. In some examples, the guiding alignment features can be provided on both the rotor shell and the spindle and can include tapered plates, conical features, or series of stepped surfaces.

The above detailed description is intended to be illustrative, and not restrictive. The scope of the disclosure should, therefore, be determined with references to the appended claims, along with the full scope of equivalents to which such claims are entitled.

What is claimed is:

1. A milling machine comprising:

a frame;

a milling assembly including a cutting rotor and a rotor housing coupled to the frame, the cutting rotor including a rotor shell positioned around a spindle; and a first axial alignment feature on one of the rotor shell or the spindle, the first axial alignment feature including a physical feature on a surface of the rotor shell or the spindle, the physical feature being positioned and configured to contact an opposing flat surface of the opposing rotor shell or spindle so as to guide the rotor shell and the spindle into a co-axial alignment as the rotor shell is loaded axially onto the spindle.

2. The milling machine of claim 1, wherein the first axial alignment feature is on an inner surface of the rotor shell and is located at a non-drive side of the rotor shell.

3. The milling machine of claim 1, further including a second axial alignment feature on the other one of the rotor shell or the spindle, the second axial alignment feature including a physical feature on a surface of the other one of the rotor shell or the spindle, the physical feature being positioned and configured to contact an opposing flat surface of the opposing rotor shell or spindle so as to guide the rotor shell and the spindle into a co-axial alignment as the rotor shell is loaded axially onto the spindle.

4. The milling machine of claim 3, wherein the first axial alignment feature is on an inner surface of the rotor shell and is located at a non-drive side of the rotor shell and the second axial alignment feature is on an outer surface of the spindle and is located at a drive side of the spindle.

5. The milling machine of claim 4, wherein the first axial alignment feature and the second axial alignment feature each include a plurality of tapered surfaces that contact a corresponding flat surface of the opposed rotor shell or the spindle, the plurality of tapered surfaces sized to physically align the rotor shell and the spindle to be in co-axial alignment when assembled.

6. The milling machine of claim 1, wherein the first axial alignment feature is on an outer surface of the spindle and is located at a drive side of the spindle.

7. The milling machine of claim 1, wherein the first axial alignment feature includes a plurality of tapered surfaces positioned around a circumference of an inner surface of the rotor shell that respectively contact opposing flat outer surfaces of the spindle to physically align the rotor shell and the spindle to be in co-axial alignment when the rotor shell is fully assembled upon the spindle.

8. The milling machine of claim 7, wherein, after assembly of the rotor shell to the spindle, the tapered surface is not in supporting contact with the outer surface of the spindle.

9. The milling machine of claim 1, wherein the spindle is coupled to the frame while the rotor shell is being loaded on to the spindle.

10. The milling machine of claim 1, further including keyed structures on both the spindle and the rotor shell that mate with each other when the rotor shell is fully assembled to the spindle.

11. A milling assembly comprising:

a cutting rotor including a rotor shell; and a first axial alignment feature on the rotor shell, the first axial alignment feature including a physical feature on a surface of the rotor shell, the physical feature being positioned and configured to contact an opposing flat surface of an opposing spindle so as to guide the rotor shell and the spindle into a co-axial alignment as the rotor shell is loaded axially onto the spindle, wherein after assembly of the rotor shell to the spindle, the physical feature is not in supporting contact with an opposing surface of the opposing rotor shell or the spindle.

12. The milling assembly of claim 11, wherein the first axial alignment feature is on an inner surface of the rotor shell and is located at a non-drive side of the rotor shell.

13. The milling assembly of claim 12, wherein the first axial alignment feature includes a plurality of tapered surfaces positioned around a circumference of the inner surface of the rotor shell that contact an opposing outer surface of the spindle to physically align the rotor shell and the spindle to be in co-axial alignment when the rotor shell is fully assembled upon the spindle.

14. The milling assembly of claim 13, wherein, after assembly of the rotor shell to the spindle, the tapered surfaces are not in physical contact with the outer surface of the spindle.

15. The milling assembly of claim 11, further including a second axial alignment feature on the spindle, the second axial alignment feature including a physical feature on a surface of the spindle, the physical feature being positioned and configured to contact an opposing flat surface of the opposing rotor shell so as to guide the rotor shell and the spindle into a co-axial alignment as the rotor shell is loaded axially onto the spindle.

16. The milling assembly of claim 15, wherein the first axial alignment feature and the second axial alignment feature each include a plurality of tapered surfaces that contact a corresponding surface of the opposed rotor shell or the spindle sized to physically align the rotor shell and the spindle to be in co-axial alignment when assembled.

17. A method of connecting a rotor shell to a spindle of a milling machine, the method comprising:

loading a rotor shell over a spindle from an installation side of the milling machine;

co-axially aligning the rotor shell and the spindle by moving the rotor shell relative to the spindle using axial alignment features on at least one of the rotor shell or the spindle; and assembling the rotor shell to the spindle, wherein, after assembly of the rotor shell to the spindle, the axial alignment features are not in supporting contact with a surface of the opposing rotor shell or the spindle;

wherein the axial alignment feature is on an inner surface of the rotor shell and is located at a non-drive side of the rotor shell, wherein the axial alignment feature includes a plurality of tapered surfaces positioned around a circumference of the inner surface that contact an opposing flat outer surface of the spindle to physically align the rotor shell and the spindle to be in co-axial alignment when the rotor shell is fully assembled upon the spindle.

18. The method of claim 17, further including providing a second axial alignment feature on the other one of the rotor shell or the spindle, the second axial alignment feature including a physical feature on a surface of the other one of the rotor shell or the spindle, the physical feature being positioned and configured to contact an opposing flat surface of the opposing rotor shell or spindle so as to guide the rotor shell and the spindle into a co-axial alignment as the rotor shell is loaded axially onto the spindle.

* * * * *